US010784619B2

(12) United States Patent
Ochiai et al.

(10) Patent No.: US 10,784,619 B2
(45) Date of Patent: Sep. 22, 2020

(54) SPRING TYPE CONNECTOR

(71) Applicants: YAZAKI CORPORATION, Tokyo (JP); HONDA MOTOR CO., LTD., Tokyo (JP)

(72) Inventors: Kazuyuki Ochiai, Saitama (JP); Daisuke Fujihira, Saitama (JP); Shintaro Matsuda, Saitama (JP); Kozo Oishi, Tochigi (JP); Tomoyuki Miyakawa, Tochigi (JP)

(73) Assignees: YAZAKI CORPORATION, Tokyo (JP); HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 16/472,652

(22) PCT Filed: Nov. 30, 2017

(86) PCT No.: PCT/JP2017/043212
§ 371 (c)(1),
(2) Date: Jun. 21, 2019

(87) PCT Pub. No.: WO2018/139051
PCT Pub. Date: Aug. 2, 2018

(65) Prior Publication Data

US 2019/0363486 A1 Nov. 28, 2019

(30) Foreign Application Priority Data

Jan. 24, 2017 (JP) ..... 2017-010296

(51) Int. Cl.
*H01R 13/627* (2006.01)
*H01R 13/52* (2006.01)

(52) U.S. Cl.
CPC ..... *H01R 13/627* (2013.01); *H01R 13/5219* (2013.01)

(58) Field of Classification Search
CPC .. H01R 13/627; H01R 13/5219; H01R 13/52; H01R 13/5202; H01R 13/5205; H01R 13/5208; H01R 13/521
(Continued)

(56) References Cited

U.S. PATENT DOCUMENTS 5,082,455 A * 1/1992 Wei ..... H01R 13/6271 439/352
5,655,916 A * 8/1997 Hayashi ..... H01R 13/641 439/153
(Continued)

FOREIGN PATENT DOCUMENTS

CN 102957044 A 3/2013
JP 7-192806 A 7/1995
(Continued)

OTHER PUBLICATIONS

International Search Report and Written Opinion of the International Search Report for PCT/JP2017/043212 dated Feb. 13, 2018.

*Primary Examiner* — Harshad C Patel
(74) *Attorney, Agent, or Firm* — Kenealy Vaidya LLP

(57) ABSTRACT

One of a pair of connectors of a spring type connector includes an inner housing, an outer housing, a gap defined between the inner housing and the outer housing, retaining mechanisms, and a spring. The retaining mechanism includes a pair of abutting members provided on the inner housing and the outer housing, and a cushioning member provided between the pair of the abutting members.

9 Claims, 7 Drawing Sheets

(58) Field of Classification Search
USPC ..... 439/271
See application file for complete search history.

(56) References Cited

U.S. PATENT DOCUMENTS

| | | | | | |
|---|---|---|---|---|---|
| 5,791,930 | A * | 8/1998 | Tabata | H01R 13/641 | 439/345 |
| 5,820,400 | A * | 10/1998 | Yamanashi | H01R 13/6272 | 439/358 |
| 5,827,086 | A * | 10/1998 | Fukuda | H01R 13/6272 | 439/357 |
| 6,065,991 | A * | 5/2000 | Fukuda | H01R 13/641 | 439/352 |
| 6,171,130 | B1 * | 1/2001 | Yoshida | H01R 13/641 | 439/350 |
| 6,231,368 | B1 | 5/2001 | Murakami et al. | | |
| 6,358,081 | B1 * | 3/2002 | Saka | H01R 13/641 | 439/352 |
| 6,475,015 | B1 | 11/2002 | Murakami et al. | | |
| 6,572,394 | B1 | 6/2003 | Yamaoka et al. | | |
| 7,404,731 | B2 | 7/2008 | Lim | | |
| 9,270,055 | B2 * | 2/2016 | Campbell | H01R 43/26 | |
| 10,476,203 | B2 * | 11/2019 | Oishi | H01R 13/627 | |

FOREIGN PATENT DOCUMENTS

| | | | |
|---|---|---|---|
| JP | 10-223311 | A | 8/1998 |
| JP | 11-224728 | A | 8/1999 |
| JP | 2000-357561 | A | 12/2000 |
| JP | 2000-357562 | A | 12/2000 |

* cited by examiner (a)

(b)

(a)

(b)

(a)

(b)

SPRING TYPE CONNECTOR

TECHNICAL FIELD

The present invention relates to a spring type connector, and more specifically, a spring type connector including a spring that is configured to forcibly release fitting when a pair of connectors is in a half fitting state and in a fitting releasing state (hereinafter, collectively referred to as "half fitting state").

BACKGROUND ART

Generally, the connector includes a lock mechanism in which both connectors of a female connector and a male connector are engaged with each other at a fitting position. Further, a spring type connector is known which forcibly releases fitting by a biasing force of a spring in a half fitted state in which both connectors do not reach the fitting position. For example, one of the connectors is assembled with an inner housing and an outer housing that surrounds the inner housing so as to be relatively slidable in fitting directions, and the spring is provided between the two housings so as to bias the inner housing in a direction away from the other connector with respect to the outer housing. Then, the inner housing is biased in a direction of releasing fitting with respect to the outer housing (hereinafter referred to as "anti-fitting direction") by the biasing force of the spring. In addition, a retaining mechanism for restricting relative positions of the inner housing and the outer housing in a fitting releasing direction to predetermined assembling positions may be provided such that the inner housing and the outer housing are not separated in the fitting releasing state.

For example, a female connector illustrated in FIG. 5 of Patent Document 1 includes an inner housing and an outer housing that is assembled to and surround the inner housing so as to be relatively slidable in fitting directions. A male connector includes a cylindrical portion that is inserted into a gap between the inner housing and the outer housing. The inner housing and the outer housing include a retaining mechanism that suppresses separation between the two housings and holds the two housings in predetermined assembling positions. The retaining mechanism includes an elongated hole on an upper surface of the outer housing and a protrusion that is provided on the inner housing so as to be insertable into the elongated hole. The protrusion abuts against a hole wall at one end of the elongated hole in relative sliding directions of the inner housing and the outer housing, so that a position of the protrusion is restricted.

According to the retaining mechanism provided in the outer housing and the inner housing in FIG. 5 of Patent Document 1, when the female connector and the male connector is in the half fitting state in which a lock mechanism of the female connector and the male connector is not engaged, the outer housing and the inner housing are biased respectively in the fitting releasing direction by a biasing force of a spring. At this time, the protrusion on an upper surface of the inner housing abuts against the hole wall at the one end of the elongated hole on the upper surface of the outer housing, and the retaining mechanism functions to hold the two housings at predetermined assembling positions.

PATENT LITERATURE

Patent Document 1: JP-A-11-224728

SUMMARY OF INVENTION

Technical Problem

In the spring type connector described in FIG. 5 of Patent Document 1, the protrusion of the inner housing abuts against the hole wall of the elongated hole of the outer housing by the biasing force of the spring to retaining the inner housing. Therefore, when the biasing force of the spring is increased in a case of a multipolar connector having a large number of terminals or the like, the protrusion may strongly collide with the hole wall, so that the retaining mechanism may be damaged.

An object of the present invention is to provide a spring type connector that includes a mechanism configured to push back a housing by utilizing a biasing force of a spring at a time of half fitting, and is capable of preventing or reducing damages to the mechanism.

Solution to Problem

The "spring type connector" according to one aspect of the present invention has a following feature (1), and further preferably has a following feature (2).

(1)

A spring type connector includes a pair of connectors having a lock mechanism that are engaged with each other at a fitting position.

One of the pair of the connectors includes:

an inner housing;

an outer housing that surrounds the inner housing and is assembled to and slidable to the inner housing relatively in fitting directions;

a gap defined between the inner housing and the outer housing and into which the other the pair of the connectors is capable of being inserted;

a retaining mechanism configured to suppress separation between the inner housing and the outer housing; and a spring configured to bias the inner housing and the outer housing in directions in which the inner housing and the outer housing are separated from each other.

The retaining mechanism includes:

a pair of abutting members provided on the inner housing and the outer housing so as to face each other in the fitting directions; and a cushioning member provided between the pair of the abutting members.

According to the spring type connector having the feature (1), the retaining mechanism is constituted by the pair of the abutting members. When the pair of the connectors is in a half fitting state in which the pair of the connectors is not engaged by the lock mechanism, the two housings are biased by the spring in directions in which the inner housing and the outer housing are separated from each other (anti-fitting directions). As a result, the pair of the abutting members abuts against each other, and separation between the two housings is prevented or reduced. Further, even if a biasing force of the spring is strengthened, an impact force acting between the pair of the abutting members is alleviated by the cushioning member, so that damages to the retaining mechanism can be prevented or reduced.

(2)

The spring type connector according to (1) further includes:

a watertight annular packing that is mounted on an outer peripheral surface of the inner housing and is provided in the gap.

The cushioning member is a band-shaped member that extends from the annular packing and is provided between the pair of the abutting members.

According to the spring type connector having the feature (2), the watertight annular packing provided in the gap (more specifically, provided between the outer peripheral surface of the inner housing and the inner peripheral surface of the other connector) is mounted on the outer peripheral surface of the inner housing. Further, the band-shaped member that extends from the annular packing and is provided between the pair of the abutting members is used as the cushioning member. That is, the cushioning member is formed integrally with the annular packing.

Further, the "spring type connector" according to another aspect of the present invention is configured to have a following feature (3).

(3)

A spring type connector includes a pair of connectors having a lock mechanism that are engaged with each other at a fitting position.

One of the pair of the connectors includes:

an inner housing;

an outer housing that surrounds the inner housing and is assembled to and slidable to the inner housing relatively in fitting directions;

a gap defined between the inner housing and the outer housing and into which the other the pair of the connectors is capable of being inserted;

a retaining mechanism configured to suppress separation between the inner housing and the outer housing;

a spring configured to bias the inner housing and the outer housing in directions in which the inner housing and the outer housing are separated from each other; and a watertight annular packing that is mounted on an outer peripheral surface of the inner housing and is provided in the gap.

The retaining mechanism includes a flange extending from the annular packing and a lock portion of the outer housing abutting on a back side part of the flange in the fitting directions, and is configured to suppress the outer housing from moving toward a front side in the fitting directions with respect to the flange by bringing into contact the flange on the lock portion.

According to the spring type connector having the feature (3), the flange extending from the watertight annular packing mounted on the outer peripheral surface of the inner housing and a step portion of the outer housing abut against each other so as to suppress separation between the two housings while using the flange as the cushioning member. That is, the flange and the step portion constitute the retaining mechanism. According to the spring type connector having the present feature, it is possible to omit the retaining mechanism (mechanism using the pair of the abutting members) according to the one aspect described above. Further, the collision force at a time of abutting is alleviated by the cushioning member (the flange of the annular packing), so that even if the biasing force of the spring is strengthened, damages to the retaining mechanism can be prevented or reduced.

Advantageous Effects of Invention

According to the present invention, the spring type connector that includes the mechanism which is configured to push back the housing by utilizing the biasing force of the spring at the time of half fitting is capable of preventing or reducing damages to the mechanism.

DESCRIPTION OF EMBODIMENTS

Figure 1:
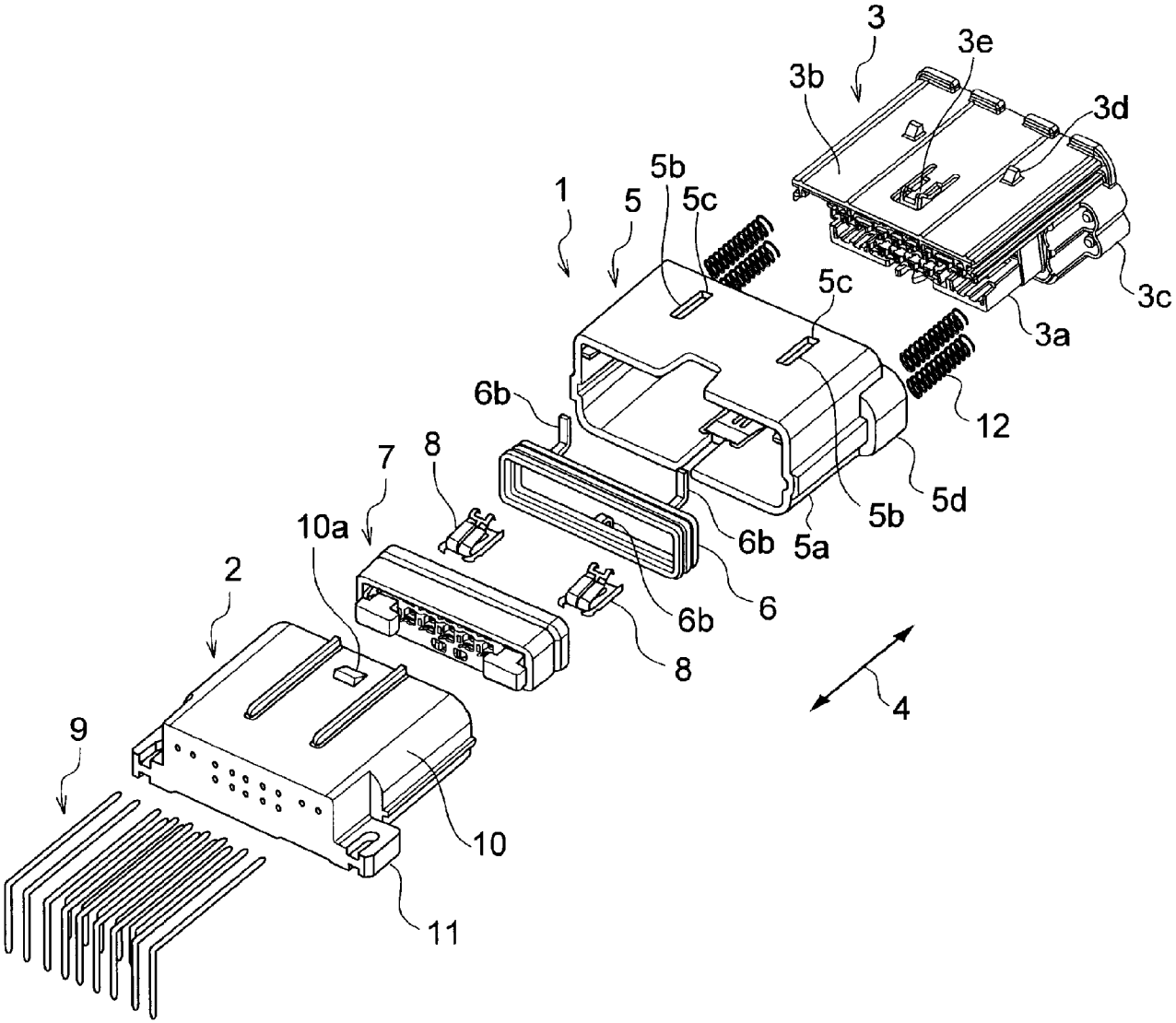
FIG. 1 is an exploded perspective view of a spring type connector according to a first embodiment of the present invention.

Hereinafter, the present invention is described based on embodiments.

First Embodiment

A spring type connector according to a first embodiment of the present invention is described with reference to FIGS. 1 to 5. As illustrated in an exploded view of FIG. 1, the spring type connector includes a female connector 1 and a male connector 2. The female connector 1 includes an inner housing 3 accommodating a plurality of female terminals, and an outer housing 5 that surrounds the inner housing 3 and is assembled to and relatively slidable to the inner housing 3 along fitting directions indicated by an arrow 4. The inner housing 3 includes a cylindrical portion 3*a* that surrounds an accommodation chamber which is configured to accommodate the plurality of female terminals, and an upper plate 3*b* that is a cover member provided above the cylindrical portion 3*a* with a space therebetween. The cylindrical portion 3*a* has a substantially rectangular cross section. The cylindrical portion 3*a* is formed so as to be insertable into a cylindrical portion 5*a* of the outer housing 5. The cylindrical portion 5*a* has a substantially rectangular cross section. A gap into which a cylindrical portion 10 of the male connector 2 is inserted is formed between an outer peripheral surface of the cylindrical portion 3*a* and an inner peripheral surface of the cylindrical portion 5*a*. The cylindrical portion 10 has a substantially rectangular cross section described later.

The annular packing 6 is mounted on the outer peripheral surface of the cylindrical portion 3*a*, and serves to waterproof between an inner peripheral surface of the cylindrical portion 10 of the male connector 2 and an outer peripheral surface of the inner housing 3, the cylindrical portion 10 has a substantially rectangular cross section described later. The annular packing 6 is positioned between a front holder 7 attached to a tip portion of the outer peripheral surface of the cylindrical portion 3*a* and a step portion formed in a back of the cylindrical portion 3*a*. In the present embodiment, two short terminals 8 are inserted into the corresponding accommodation chamber of the inner housing 3 to be mounted. The short terminals 8 short-circuit two specific male terminals of the male connector 2 to be fitted into the female connector 1. However, the present invention is not limited to a connector including the short terminal 8.

Meanwhile, the male connector 2 includes the cylindrical portion 10 that includes a accommodation chamber in which a plurality of needle-shaped male terminals 9 are inserted and accommodated, and has a substantially rectangular cross section. The male connector 2 of the present embodiment is used by being coupled to a circuit board (not illustrated), for example, and includes a support portion 11 that is fixed to the circuit board with bolts or the like and is provided on both side surfaces of the cylindrical portion 10. However, the male connector 2 is not limited thereto.

Figure 2:
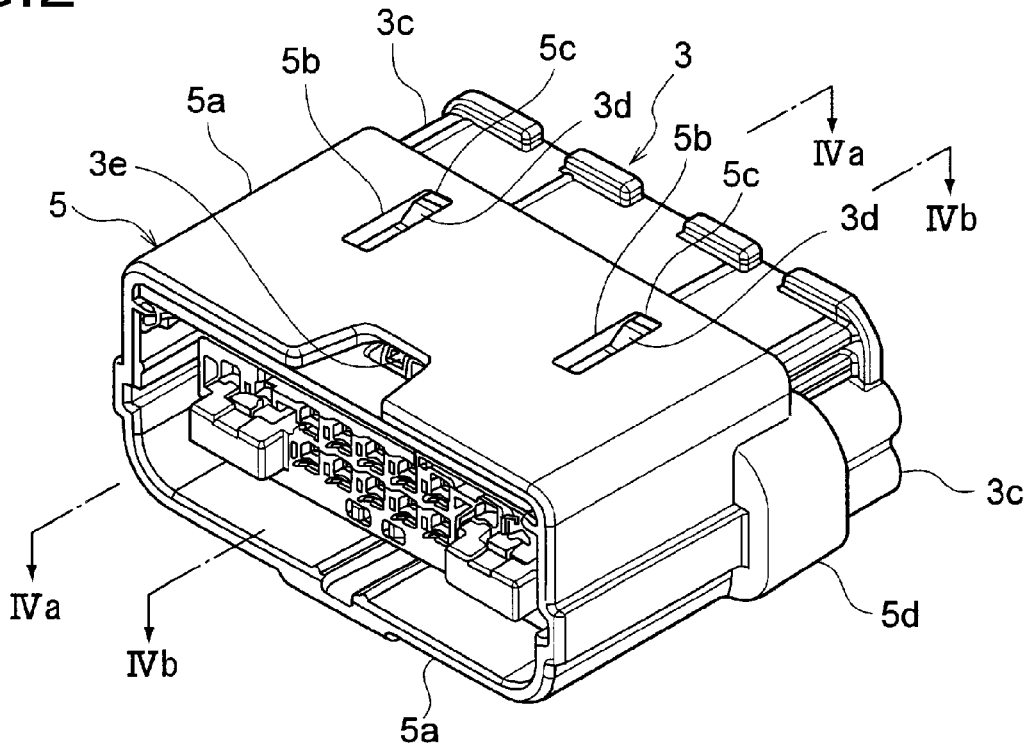
FIG. 2 is a view illustrating a female connector according to the first embodiment, FIG. 2(*a*) is a perspective view of the female connector, and FIG. 2(*b*) is a front view of the female connector as viewed from a male connector side.
Figure 2:
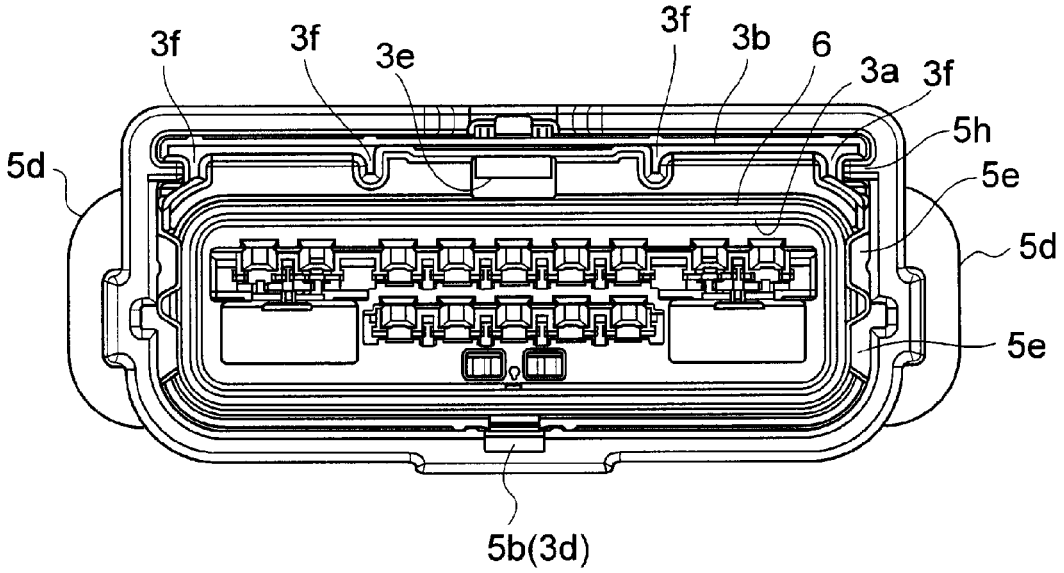

Here, a retaining mechanism that is configured to maintain the inner housing 3 and the outer housing 5 of the female connector 1 in a predetermined assembled state and suppress separation between the inner housing 3 and the outer housing 5, and a lock mechanism that is configured to maintain a fitting state between the female connector 1 and the male connector 2 are described. First, the inner housing 3 and the outer housing 5 are assembled so as to be slidable relatively in the fitting directions indicated by the arrow 4 in FIG. 1. The inner housing 3 and the outer housing 5 are biased in a direction in which the inner housing 3 and the outer housing 5 are separated from each other by a plurality of coiled springs 12. As illustrated in FIGS. 1 and 2(*a*), a spring accommodation portion 3*c* is provided at a rear end portion of a side surface of the inner housing 3, and a spring accommodation portion 5*d* is provided at a rear end portion of a side surface of the outer housing 5 in correspondence therewith. One end of the spring 12 is slidably accommodated in the spring accommodation portion 3*c*, and another end of the spring 12 is accommodated in the spring accommodation portion 5*d*. The spring 12 biases the inner housing 3 and the outer housing 5 in directions in which the inner housing 3 and the outer housing 5 are separated from each other (anti-fitting directions) along the fitting directions indicated by the arrow 4 in FIG. 1.

Figure 3:
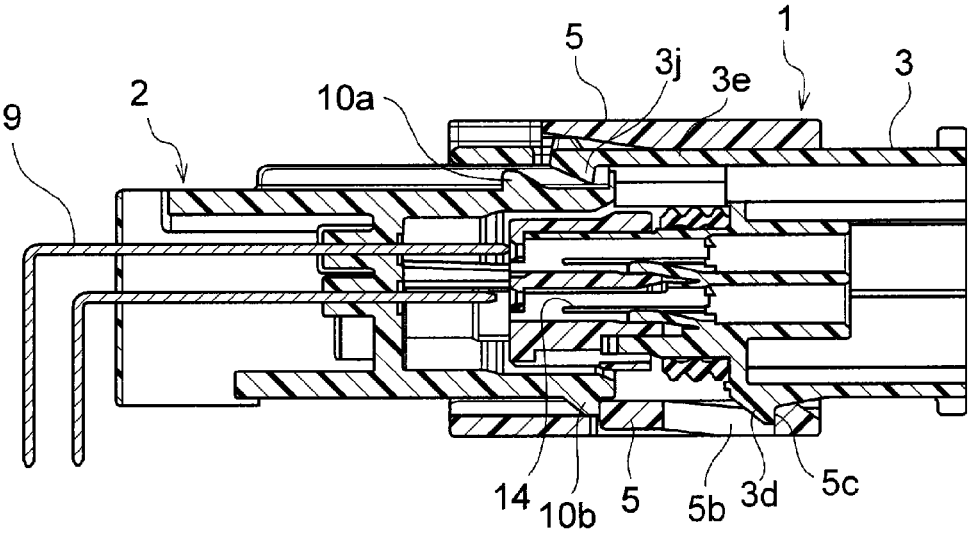
FIG. 3 is a view illustrating an operation at a time of fitting the female connector and the male connector according to the first embodiment.
Figure 3:
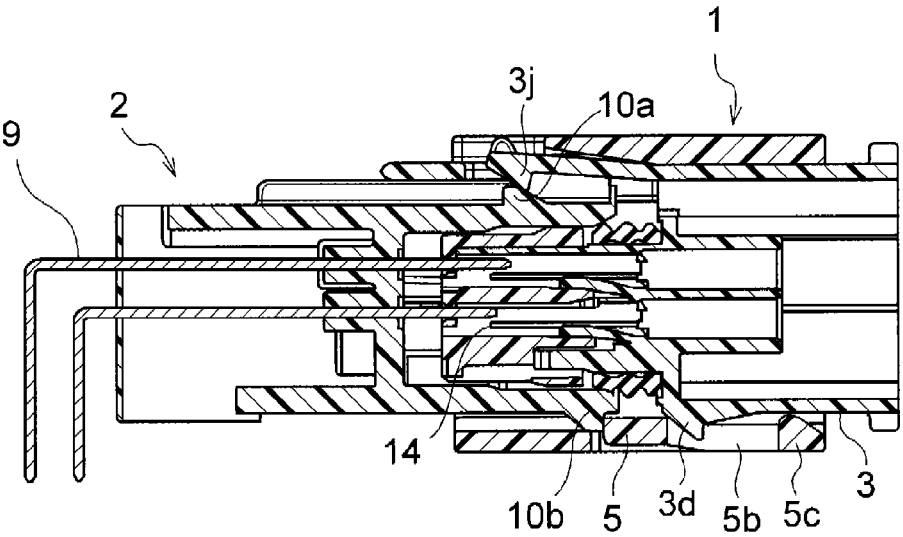

Here, the lock mechanism in the fitting state of the female connector 1 and the male connector 2 is described. The lock mechanism includes a lock claw 3*j* of a lock arm 3*e* formed on an upper plate 3*b* of the inner housing 3 of the female connector 1, and a protrusion 10*a* formed to protrude from an upper surface of the cylindrical portion 10 of the male connector 2. As illustrated in FIG. 3(*a*), when the male connector 2 is pushed into the female connector 1, a protrusion 10*b* provided on a lower surface of the cylindrical portion 10 of the male connector 2 abuts against a tip portion of the outer housing 5, so that a position of the male connector 2 with respect to the outer housing 5 is determined. Further, if the inner housing 3 is pushed in, as illustrated in FIG. 3(*b*), the lock claw 3*j* at a tip end of the lock arm 3*e* abuts against the protrusion 10*a* of the male connector 2, so that the lock arm 3*e* elastically deforms and the lock claw 3*j* rides on the protrusion 10*a*. If the inner housing 3 is further pushed in, the lock claw 3*j* rides over the protrusion 10*a* and is locked to the protrusion 10*a*. In this manner, the lock mechanism is engaged, a fitting of the female connector 1 and the male connector 2 is completed, and electrical connection between the female terminal 14 and the male terminal 9 in correspondence with the female connector 1 and the male connector 2 is maintained. When the female connector 1 and the male connector 2 is in a half fitting state in which the lock mechanism of the female connector and the male connector is not engaged, the spring 12 biases the female connector 1 and the male connector 2 in the anti-fitting directions in which the housings of the male connector 1 and the male connector 2 are separated, so that the retaining mechanism operates.

Next, the retaining mechanism related to features of the present embodiment is described. The retaining mechanism that is configured to maintain the assembled state of the female connector 1 and suppress separation between the housings includes elongated holes 5*b* formed on an upper surface of the outer housing 5 and protrusions 3*d* formed on the upper plate 3*b* of the inner housing 3 so as to be insertable into the elongated holes 5*b* respectively. The elongated hole 5*b* is formed so as to have a long axis in relative sliding directions of the inner housing 3 and the outer housing 5. The protrusions 3*d* slidably inserted into the elongated holes 5*b* abuts against hole walls 5*c* at one end in sliding directions to regulate a position of the inner housing 3 with respect to the outer housing 5. That is, a pair of abutting members of the retaining mechanism includes the hole wall 5*c* and the protrusion 3*d*. As illustrated in FIG. 2(*b*), two sets of the retaining mechanisms according to the present embodiment are provided on the upper plate 3*b* of the inner housing 3 and an upper cylindrical surface of the outer housing 5 corresponding to the upper plate 3*b* of the inner housing 3, and one set of the retaining mechanism is provided on a lower cylindrical surface of the cylindrical portion 3*a* of the inner housing 3 and a lower cylindrical surface of the outer housing 5 corresponding to the lower cylindrical surface of the cylindrical portion 3*a* of the inner housing 3. However, the present invention is not limited to the present embodiment.

As illustrated in FIG. 2(*b*), reinforcing ribs 3*f* are provided on a lower surface of the upper plate 3*b* on the cylindrical portion 3*a* side. Side edges on both sides of the upper plate 3*b* are slidably supported by ribs 5*h* formed on an inner surface of the outer housing 5.

Figure 4:
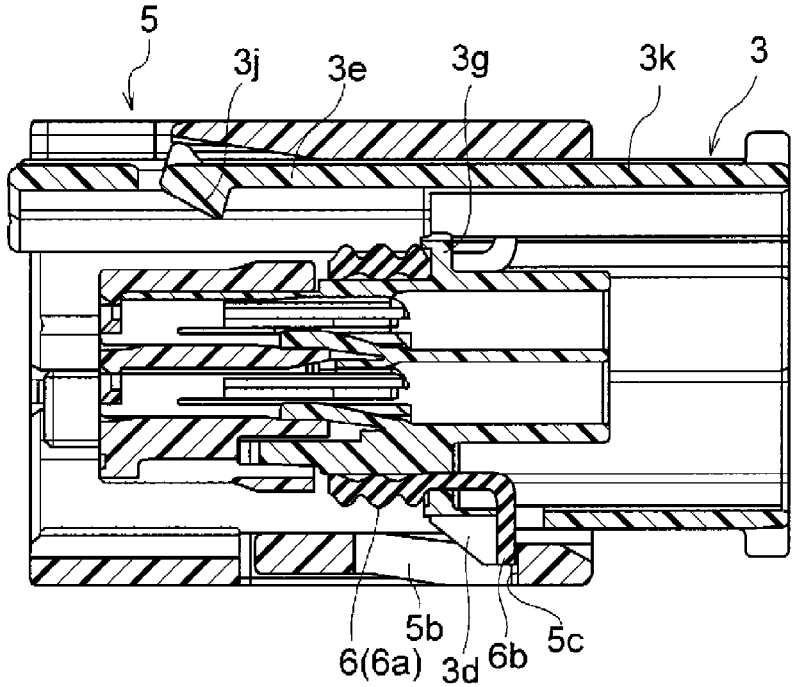
FIG. 4 is a view illustrating a cushioning member provided in a retaining mechanism of the female connector according to the first embodiment.
Figure 4:
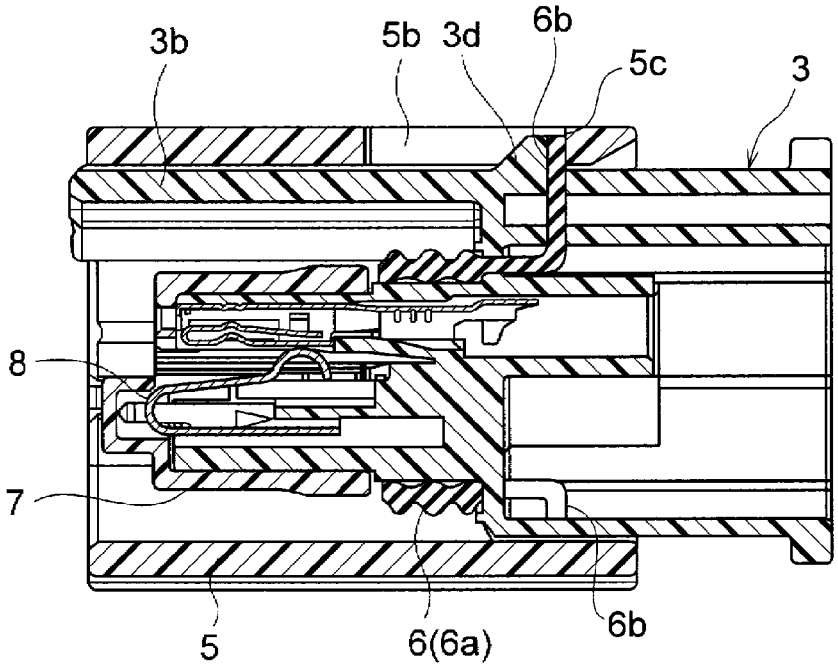
Figure 5:
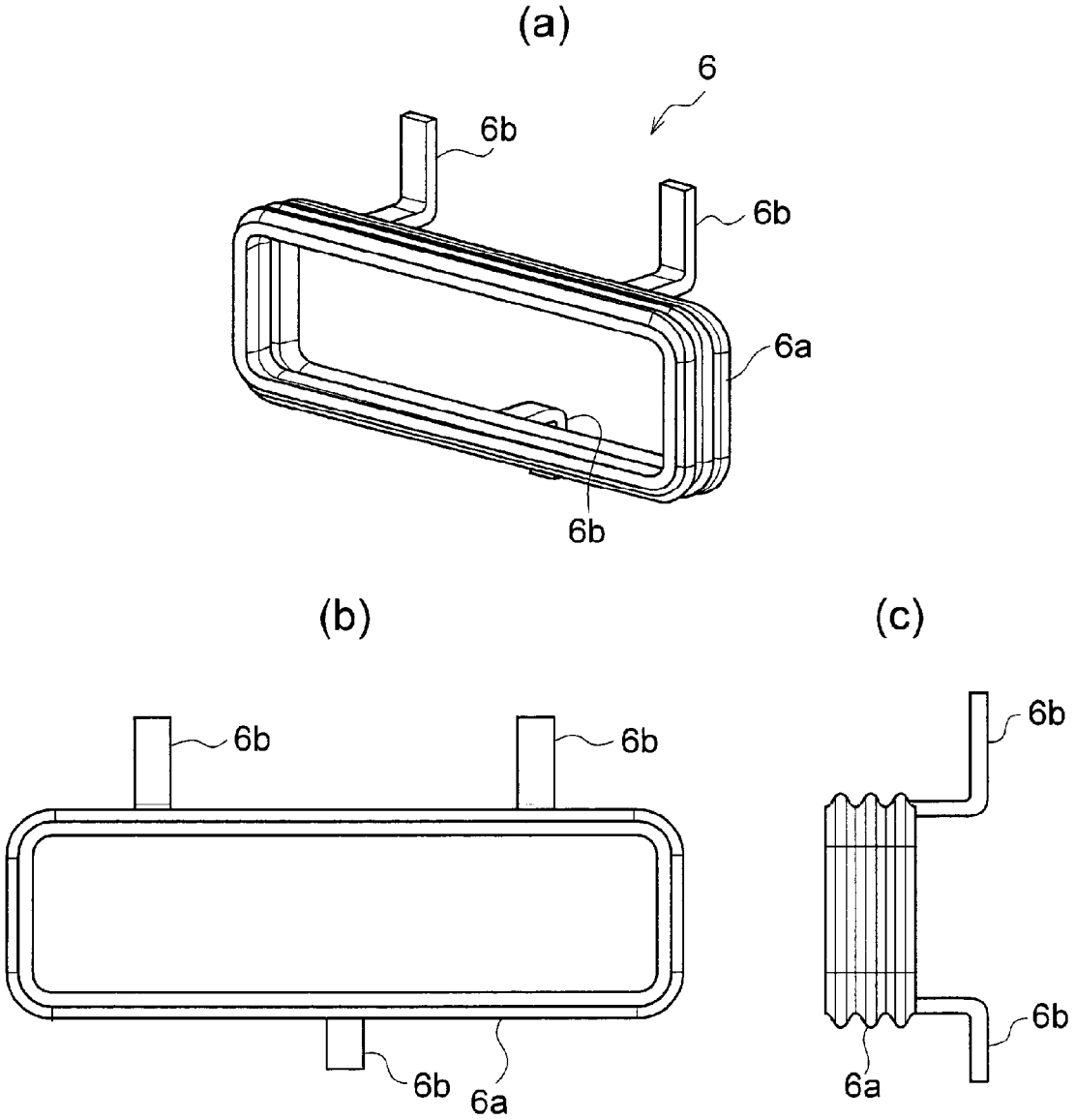
FIG. 5 is a configuration view of an annular packing that includes the cushioning member provided in the retaining mechanism of the female connector according to the first embodiment.

Referring to FIGS. 4 and 5, a cushioning member of the retaining mechanism according to features of the present embodiment is described. FIGS. 4(*a*) and 4(*b*) are cross-sectional views of the inner housing 3 and the outer housing 5 in the predetermined assembled state. FIG. 4(*a*) is a cross-sectional view taken along an arrow IVa in FIG. 2(*a*) at a fitting axis position, and FIG. 4(*b*) is a cross-sectional view taken along an arrow IVb in the elongated hole 5*b* in the front of FIG. 2(*a*) at a position of the long axis. FIG. 5 illustrates a configuration of the annular packing 6. The annular packing 6 includes a rectangular packing main body portion 6*a* mounted on the outer peripheral surface of the inner housing 3, and a band-shaped cushioning member 6*b* that is formed to extend from an end surface of the packing main body portion 6*a* in a depth direction. That is, the cushioning member 6*b* is preferably formed of the same material (for example, silicon rubber) integrally with the annular packing 6.

As illustrated in FIG. 4, the annular packing 6 is mounted on the outer peripheral surface of the cylindrical portion 3*a* of the inner housing 3. A partition wall 3*g* is provided on the end surface of the packing main body portion 6*a* in the depth direction from an upper surface of the outer peripheral surface of the cylindrical portion 3*a* toward a lower surface of the upper plate 3*b* of the inner housing 3. A cylindrical wall including a partition wall is formed from a lower surface of the outer peripheral surface of the cylindrical portion 3*a* toward an inner surface of the cylindrical portion 5*a* of the outer housing 5. The packing body portion 6*a* is positioned and fixed between an end face of the front holder 7 mounted from a tip portion of the inner housing 3, and the partition wall 3*g* of the inner housing 3 and the cylindrical wall including the partition wall. The band-shaped cushioning member 6*b* extends from a portion where the packing main body 6*a* abuts against the partition wall 3*g* or the cylindrical wall including the partition wall, and is inserted into a gap where the hole wall 5*c* of the elongated hole 5*b* constituting the retaining mechanism and the protrusion 3*d* face each other. The cushioning member 6*b* may be provided separately from the packing main body portion 6*a*, and may be inserted into the gap where the hole wall 5*c* and the protrusion 3*d* face each other. However, a number of components can be reduced to facilitate work management at a time of assembly by integrally forming the cushioning member 6*b* and the packing main body portion 6*a*.

With this configuration, according to the present embodiment, the retaining mechanism is formed such that the protrusion 3*d* and the hole wall 5*c* provided so as to face both housings of the inner housing 3 and the outer housing 5 abut against each other. The cushioning member 6*b* is inserted or provided between the protrusion 3*d* and the hole wall 5*c*, so that when the female connector 1 and the male connector 2 are in a half fitting state or the like, even if the inner housing 3 and the outer housing 5 are separated by the spring 12 in the anti-fitting directions in which a fitting of the inner housing 3 and the outer housing 5 are forcibly released, the protrusion 3*d* and the hole wall 5*c* abut against each other so that the inner housing 3 and the outer housing 5 are held at predetermined assembling positions. Further, when the female connector 1 and the male connector 2 have a large number of terminals, a biasing force of the spring is strengthened and the impact force acting between the abutting members of the protrusion 3*d* and the hole wall 5*c* is alleviated by the cushioning member 6*b*, so that damages to the protrusion 3*d* can be prevented or reduced.

Second Embodiment

A spring type connector according to a second embodiment of the present invention is described with reference to FIGS. 6 and 7. The present embodiment is different from the first embodiment in configurations of the retaining mechanism, and other configurations are the same as those of the first embodiment. Therefore, only the differences are described, and description of the other configurations is omitted.

Figure 6:
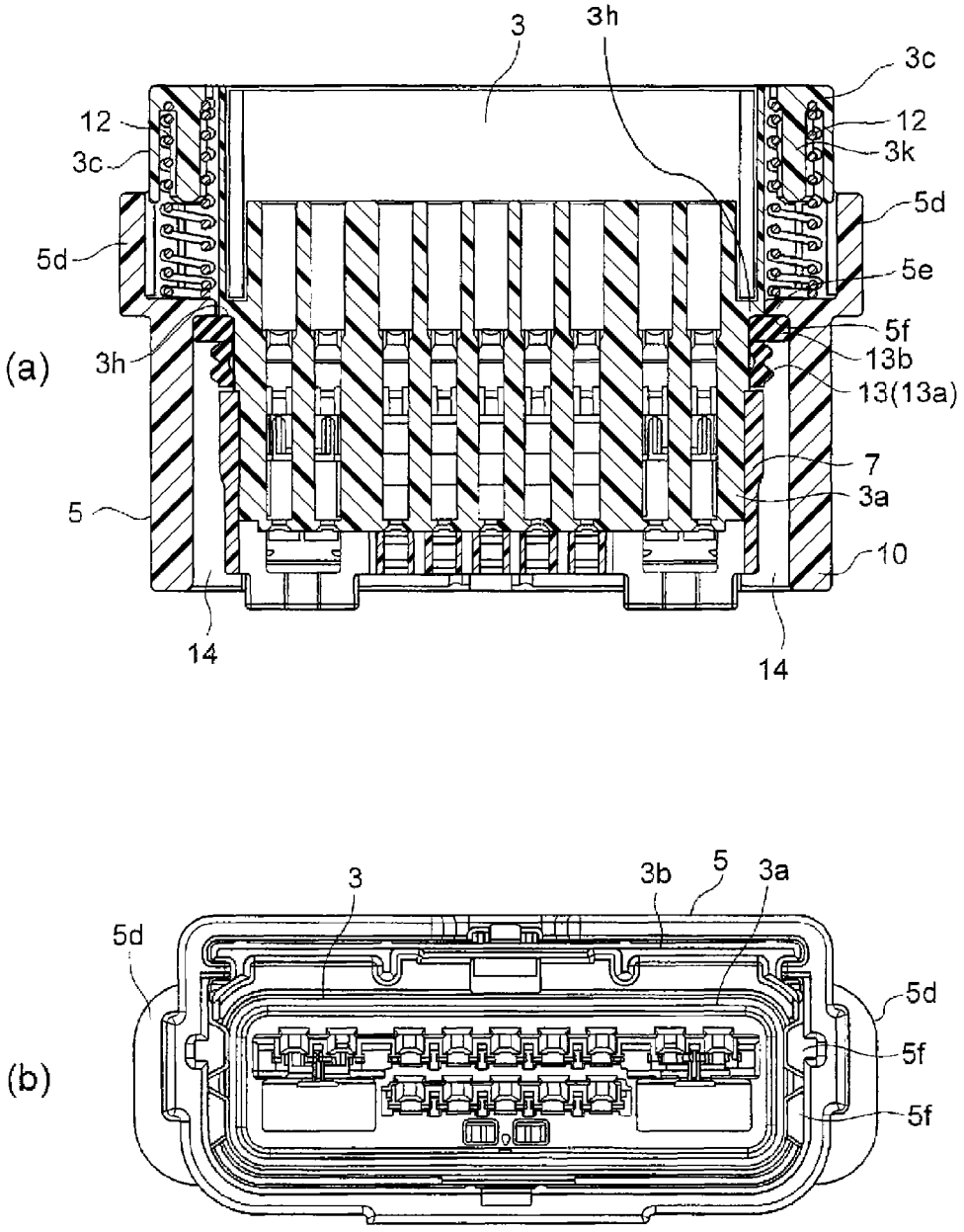
FIG. 6 is a view illustrating a main portion of the female connector according to a second embodiment of the present invention, FIG. 6(*a*) is a cross-sectional view of the main portion of the female connector, and FIG. 6(*b*) is a front view of the main portion of the female connector as viewed from a male connector side.
Figure 7:
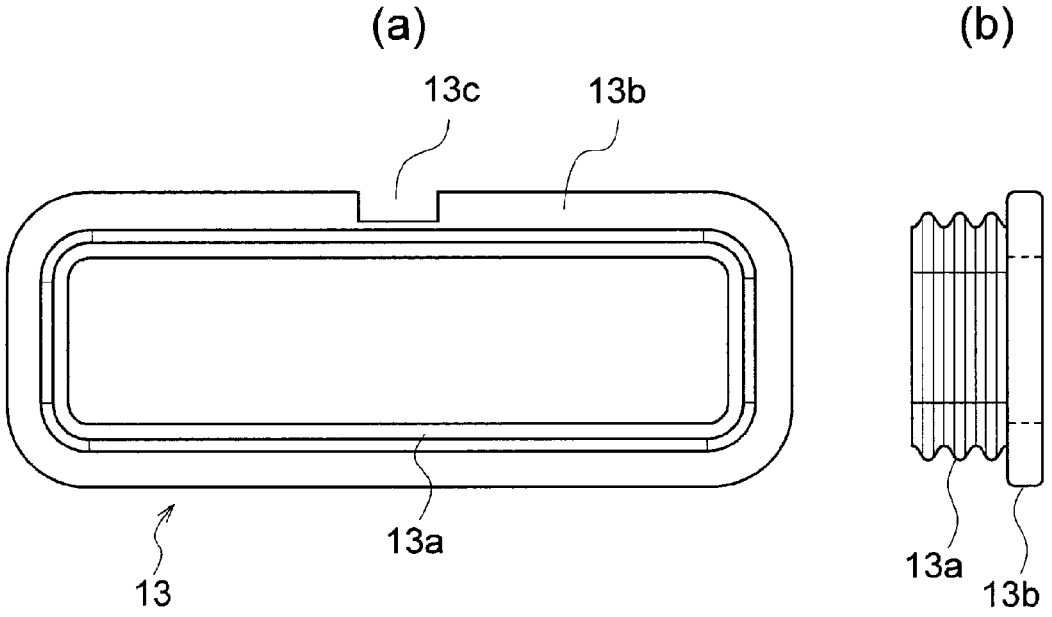
FIG. 7 is a configuration view of an annular packing constituting a retaining mechanism of the female connector according to the second embodiment, FIG. 7(*a*) is a front view of the annular packing, and FIG. 7(*b*) is a side view of the annular packing.

FIG. 6 illustrates a configuration of the female connector 1 according to the present embodiment, FIG. 6(*a*) is a cross-sectional view taken along a central axis of the upper spring 12, and FIG. 6(*b*) is a front view of the female connector 1 as viewed from a male connector 2 side. As illustrated in FIG. 7, the annular packing 13 according to the present embodiment includes an annular packing main body 13*a* mounted on the cylindrical portion 3*a* of the inner housing 3, and a flange 13*b* integrally formed at an end portion on a back side in a drawing of the packing main body 13*a*. A notch 13*c* is formed in the flange 13*b*. The notch 13*c* is located at a center of an upper surface of the cylindrical portion 3*a* of the inner housing 3. However, the notch 13*c* is not necessarily required.

As illustrated in FIG. 6(*a*), the annular packing 13 is mounted on a outer periphery of the cylindrical portion 3*a* of the inner housing 3 with the flange 13*b* on the back side. A step portion 3*h* having a stepped surface is formed on the outer periphery of the cylindrical portion 3*a*. The step portion 3*h* is formed at the predetermined assembling positions of the inner housing 3 and the outer housing 5 in accordance with a position of a back surface 5*f* of a spring receiver 5*e* forming the spring accommodation portion 5*d* of the outer housing 5. In FIG. 6(*a*), reference numeral 3*k* denotes a guide rod of the spring 12. Therefore, when the annular packing 13 is mounted on the outer periphery of the cylindrical portion 3*a* of the inner housing 3 with the flange 13*b* on the back side, a back side surface of the flange 13*b* is mounted so as to abut against both the step portion 3*h* and the back surface 5*f*. A state illustrated in FIG. 6(*a*) is predetermined assembling positions of the inner housing 3 and the outer housing 5, and is positions where the female connector 1 and the male connector 2 are forcibly returned by a biasing force of the spring 12 when the female connector 1 and the male connector 2 are in the half fitting state. That is, the retaining mechanism is constituted by the flange 13*b* of the annular packing 13 mounted on the inner housing 3 and the back surface 5*f* of the spring receiver 5*e* (lock portion) of the outer housing 5.

Therefore, when the female connector 1 and the male connector 2 are in the half fitting state, the inner housing 3 protruding downward in FIG. 6(*a*) from the outer housing 5 is pushed back by the spring 12 to return to an illustrated position. At this time, the flange 13*b* of the annular packing 13 collides against the back surface 5*f* of the spring receiver 5*e*. However, the impact force thereof is sufficiently alleviated by the flange 13*b*, so that even if the biasing force of the spring 12 is strong, it is possible to suppress damages to the retaining mechanism. In a case of the present embodiment, the retaining mechanism according to the first embodiment can be omitted.

As described above, in the present embodiment, the watertight annular packing 13 inserted between the outer peripheral surface of the inner housing 3 and the inner peripheral surface of the cylindrical portion 10 of the male connector 2 is mounted. The outer housing 5 includes the back surface 5*f* of a spring reception portion located at a back of the gap into which the cylindrical portion 10 of the male connector 2 is inserted. The gap is located at an end portion on a back side of the annular packing 13. The flange 13*b*, which is formed integrally with the annular packing 13 and is formed so as to be able to abut against the back surface 5*f* of the spring receiver 5*e* of the outer housing 5, is provided so as to constitute the retaining mechanism in which the flange 13*b* serves as the cushioning material.

While specific embodiments have been described above, the present invention is not limited to appearances and configurations in the embodiments, and various modifications, additions, and deletions are possible without changing the spirit of the present invention.

Here, characteristics of the spring type connector according to the embodiments of the present invention described above are summarized briefly in the following (1) to (3), respectively.

(1)

A spring type connector includes a pair of connectors having a lock mechanism that are engaged with each other at a fitting position.

One of the pair of the connectors (1) includes:

an inner housing (3);

an outer housing (5) that surrounds the inner housing and is assembled to and slidable to the inner housing relatively in fitting directions;

a gap defined between the inner housing and the outer housing and into which the other the pair of the connectors is capable of being inserted;

a retaining mechanism (3*d*, 5*c*) configured to suppress separation between the inner housing and the outer housing; and a spring (12) configured to bias the inner housing and the outer housing in directions in which the inner housing and the outer housing are separated from each other.

The retaining mechanism includes:

a pair of abutting members (3*d*, 5*c*) provided on the inner housing and the outer housing so as to face each other in the fitting directions; and a cushioning member (6*b*) provided between the pair of the abutting members.

(2)

The spring type connector according to (1) further includes:

a watertight annular packing (6) that is mounted on an outer peripheral surface of the inner housing and is provided in the gap.

The cushioning member (6*b*) is a band-shaped member that extends from the annular packing and is provided between the pair of the abutting members (3*d*, 5*c*).

(3)

A spring type connector includes a pair of connectors having a lock mechanism that are engaged with each other at a fitting position.

One of the pair of the connectors (1) includes:

an inner housing (3);

an outer housing (5) that surrounds the inner housing and is assembled to and slidable to the inner housing relatively in fitting directions;

a gap defined between the inner housing and the outer housing and into which the other the pair of the connectors is capable of being inserted;

a retaining mechanisms (5*e*, 13*b*) configured to suppress separation between the inner housing and the outer housing;

a spring (12) configured to bias the inner housing and the outer housing in directions in which the inner housing and the outer housing are separated from each other; and a watertight annular packing (6) that is mounted on an outer peripheral surface of the inner housing and is provided in the gap.

The retaining mechanism includes a flange (13*b*) extending from the annular packing and a lock portion (5*e*) of the outer housing abutting on a back side part of the flange in the fitting directions, and is configured to suppress the outer housing from moving toward a front side in the fitting directions with respect to the flange by abutting between the flange and the lock portion.

The present application is based on a Japanese Patent Application (JP-2017-010296) filed on Jan. 24, 2017, contents of which are incorporated herein by reference.

INDUSTRIAL APPLICABILITY

According to a spring-equipped connector according to the present invention, the spring type connector that includes the mechanism which is configured to push back the housing by utilizing the biasing force of the spring at the time of half fitting is capable of preventing or reducing damages to the mechanism. The present invention having this effect is useful for a spring type connector.

REFERENCE SIGNS LIST

1 female connector
2 male connector
3 inner housing
3*d* protrusion
3*e* lock arm
3*j* lock claw
5 outer housing
5*b* elongated hole
5*c* hole wall
5*e* spring receiver (lock portion)
6 annular packing
7 front holder
10 cylindrical portion
10*a* protrusion
10*b* protrusion

The invention claimed is:

1. A spring type connector comprising:

a pair of connectors having a lock mechanism that are engaged with each other at a fitting position, wherein one of the pair of the connectors includes:

an inner housing;

an outer housing that surrounds the inner housing, and is assembled to and slidable to the inner housing relatively in fitting directions;

a gap defined between the inner housing and the outer housing and into which the other of the pair of the connectors is capable of being inserted;

a retaining mechanism configured to suppress separation between the inner housing and the outer housing; and a spring configured to bias the inner housing and the outer housing in directions in which the inner housing and the outer housing are separated from each other, and wherein the retaining mechanism includes:

a pair of abutting members provided on the inner housing and the outer housing so as to face each other in the fitting directions; and a cushioning member provided between the pair of the abutting members.

2. The spring type connector according to claim 1, further comprising:

a watertight annular packing that is mounted on an outer peripheral surface of the inner housing and is provided in the gap, wherein the cushioning member is a band-shaped member that extends from the annular packing and is provided between the pair of the abutting members.

3. The spring type connector according to claim 1, wherein the cushioning member is provided between respective abutting surfaces of the pair of the abutting members.

4. The spring type connector according to claim 1, wherein the cushioning member is configured to abut the pair of the abutting members.

5. The spring type connector according to claim 1, wherein the cushioning member is provided between respective surfaces of the pair of the abutting members that face each other in the fitting directions.

6. The spring type connector according to claim 1, wherein the pair of the abutting members sandwich the cushioning member therebetween.

7. The spring type connector according to claim 1, wherein the cushioning member is configured to absorb at least part of a force exerted by the spring.

8. The spring type connector according to claim 1, wherein the pair of abutting members includes a protrusion provided on one of the inner housing and the outer housing and a hole wall of a hole provided in the other of the inner housing and the outer housing, and wherein protrusion abuts against the hole wall in a state that the protrusion is inserted into the hole.

9. A spring type connector comprising:

a pair of connectors having a lock mechanism that are engaged with each other at a fitting position, wherein one of the pair of the connectors includes:

an inner housing;

an outer housing that surrounds the inner housing and is assembled to and slidable to the inner housing relatively in fitting directions;

a gap defined between the inner housing and the outer housing and into which the other of the pair of the connectors is capable of being inserted;

a retaining mechanism configured to suppress separation between the inner housing and the outer housing;

a spring configured to bias the inner housing and the outer housing in directions in which the inner housing and the outer housing are separated from each other; and a watertight annular packing that is mounted on an outer peripheral surface of the inner housing and is provided in the gap, and wherein the retaining mechanism includes a flange extending from the annular packing and a lock portion of the outer housing abutting on a back side part of the flange in the fitting directions, and is configured to suppress the outer housing from moving toward a front side in the fitting directions with respect to the flange by bringing into contact the flange on the lock portion.

* * * * *